United States Patent [19]

Chiba et al.

[11] Patent Number: 4,781,491

[45] Date of Patent: Nov. 1, 1988

[54] ROAD SURFACE HEATING VEHICLE AND A GAS SUPPLY SYSTEM THEREFOR

[75] Inventors: Tatsuhiko Chiba, Kawaguchi; Kenji Nakano, Kitamoto, both of Japan

[73] Assignee: Taisei Road Constructions Co., Ltd., Tokyo, Japan

[21] Appl. No.: 70,720

[22] Filed: Jul. 7, 1987

[30] Foreign Application Priority Data

Dec. 17, 1986 [JP] Japan ..... 61-300620

[51] Int. Cl.[4] ..... E01C 23/14

[52] U.S. Cl. ..... 404/95; 404/84; 126/271.2 A; 62/51; 62/52

[58] Field of Search ..... 404/77, 79, 95, 84; 126/271.2 A; 62/50–52

[56] References Cited

U.S. PATENT DOCUMENTS

| | | | |
|---|---|---|---|
| 2,485,391 | 10/1949 | Lasseigne et al. | 126/271.2 A |
| 2,531,741 | 11/1950 | Peck | 126/271.2 A X |
| 3,989,401 | 11/1926 | Moench | 404/95 |
| 4,261,669 | 4/1981 | Edo | 404/95 X |
| 4,335,975 | 6/1982 | Schoelkopf | 404/95 X |
| 4,559,922 | 12/1985 | Crupi et al. | 126/271.2 A |
| 4,601,605 | 7/1986 | Damp et al. | 404/95 |

FOREIGN PATENT DOCUMENTS

| | | | |
|---|---|---|---|
| 2218350 | 8/1979 | Fed. Rep. of Germany | 404/79 |

*Primary Examiner*—Stephen J. Novosad
*Assistant Examiner*—John F. Letchford
*Attorney, Agent, or Firm*—Cushman, Darby & Cushman

[57] ABSTRACT

Disclosed is a road surface heating vehicle as well as a gas supply system therefor. The vehicle is provided with heating panels and a gas tank. It further comprises a plurality of vaporizers connected in parallel to each other by a gas line and a liquid line. The gas line is connected to the heating panels via its branch lines. The gas and liquid lines are each mounted with a solenoid valve and a pressure adjusting valve. The gas tank is equipped with necessary instruments involved, the vehicle having a body equipped with an operating board containing a microcomputer which automatically makes its control operation based on the use of the associated members, in such a way as to keep the gaseous pressure to fall within a specified range of levels. The system comprises members corresponding to the above-mentioned members constituting the vehicle, including a microcomputer adapted to automatically control the gaseous pressure so that the same may be kept within a specified range of levels.

2 Claims, 5 Drawing Sheets

ROAD SURFACE HEATING VEHICLE AND A GAS SUPPLY SYSTEM THEREFOR

BACKGROUND OF THE INVENTION

1. Field of the Invention

The present invention relates to a road surface heating vehicle and a gas supply system therefor.

2. Description of the Prior Art

Conventionally, in the case of remedying an asphalt paved road, a paved surface layer thereof was heated by a road surface heating vehicle to soften the composite asphalt material. Thereafter, the paved surface layer was scarified, an asphalt softening agent was scattered thereon, and the resulting layer was then stirred, levelled and supplemented, as the occasion demands, with a new composite paving material, by using a road surface layer reproducing vehicle. The resulting layer was then rolled by a succeeding rolling vehicle. Thus, the remedying operation was finished.

The prior art road surface heating vehicle which has hitherto been employed for such remedying purpose, generally, is of a gas burning type which is constructed such that heating panels are provided on the underside of a body of the vehicle in such a manner that they are kept at a level spaced by a prescribed distance from the surface of a road involved, the heating panels being supplied with gas from the propane gas cylinders loaded on the body of the vehicle. A number of small-sized cylinders are used as such gas cylinders.

The above-mentioned prior art road surface heating vehicle has the following problems.

(1) Since the propane gas cylinders loaded on the body of the vehicle are small-sized, at the time of filling the propane gas it is necessary to unload the cylinders the interior gas of which has been used up, and instead to load new gas cylinders filled up with the propane gas. This necessitates raising and lowering the propane gas cylinders by means of, for example, a crane, requiring a large amount of time and labour.

While the liquefied gas is charged in the gas cylinders, it deprives its surroundings of their heat when it is vaporized. As a result, the vaporizers are cooled to make the gas difficult to vaporize. This may often result in a failure to cause the heating panels to be kept at a required level of calorie, causing a remarkable decrease in the working efficiency. This tendency is prominent particularly in winter season, or on a land which is a great distance above the sea level.

SUMMARY OF THE INVENTION

The present invention has been made in order to solve the above-mentioned problems and the object thereof is to provide a road surface heating vehicle and a gas supply system therefor which are adapted to supply the gas kept always at a uniform level, to the heating panels, thereby enhancing the working efficiency involved.

To attain the above object, according to one aspect of the present invention, there is provided a road surface heating vehicle which has an automotive body and is equipped, on the underside of the automotive body, with heating panels and, on the automotive body, with a gas tank, the vehicle comprising a plurality of vaporizers disposed on the automotive body, the plurality of vaporizers being connected in parallel to each other by means of a gas line and a liquid line both of which extend from the gas tank. the gas line being made to branch into branch lines, the branch lines being connected to respective burners of the heating panels respectively, each of the liquid line and the gas lines being mounted with a solenoid valve and a pressure adjusting valve, the gas tank being equipped not only with a thermometer and a pressure adjusting valve but also with a heat directing fan at the side thereof, which, when required directs hot exhaust gases from the heating panels toward the gas tank to promote vaporization of the liquefied gas in the tank, the automotive body having disposed thereon an operating board containing therein a microcomputer to which there is connected electric circuits for a control system for said vaporizers, the solenoid valves, the pressure adjusting valves, the thermometer, and a fan motor used to drive the heat directing fan, whereby, when the gaseous pressure in the gas tank has exceeded a specified level, the microcomputer automatically causes a closing of the solenoid valve on the liquid line and at the same time causes a stopping of the fan operation, whereas, when the gaseous pressure has decreased down to a specified level, the microcomputer automatically causes a starting of the fan operation and at the same time causes opening of the solenoid valve on the liquid line so as to cause operation of the vaporizers.

According to another aspect of the present invention, there is provided a gas supply system for the road surface heating vehicle, which comprises a gas tank loaded on the vehicle, a heater provided on a body of the vehicle, a gas line provided between the gas tank and the heater, a plurality of vaporizers connected in parallel to the gas line, a liquid line connected to the plurality of vaporizers, and a microcomputer provided within an operating board provided on the body of the vehicle, the gas line and the liquid line being each mounted with a solenoid valve, the gas tank being provided with a termometer and a gas pressure gauge and also provided, at the outside thereof, with a heat directing fan, which, when required directs hot exhaust gases from the heating panels towards the gas tank to promote vaporization of the liquefied gas in the tank, the microcomputer being connected thereto with electric circuits for the vaporizers, the solenoid valves, the thermometer, the gaseous pressure gauge, and a fan motor, whereby the microcomputer performs its control operation in such a way that when, in operation, the pressure of the gas being supplied is kept at a level of 10 kg/cm$^2$ or more, or alternatively when the temperature of the gas tank has exceeded a level of 40° C., it automatically causes a closing of the solenoid valve on the liquid line and at the same time a stopping of the fan motor, whereas, when, in operation, the pressure of the gas being supplied has decreased down to a level of 5 /cm$^2$ or less, the microcomputer automatically causes a rotation of the fan motor and at the same time causes opening of the solenoid valve on the liquid line so as to cause operation of the vaporizers.

By turning a main switch on, each solenoid valve is opened to permit the vaporizer to operate. This permits the gas to be supplied to each heating panel, which gas is then automatically ignited. Whereby, the road surface heating vehicle can heat the surface of the paved road at a specified temperature.

During the above operation, when, in summer season, the liquefied gas is spontaneously vaporized within the gas tank with the result that the gaseous pressure has a level of 10 kg/cm$^2$ or more or the interior temperature of the gas tank exceeds 40° C., the automatic control system starts to operate. Consequently, the solenoid valve on the liquid line adapted to supply the liquefied gas from the gas tank to the vaporizers is closed and, at the same time, the heat directing fan adapted to promote the vaporization in the gas tank is stopped from operating. When, on the other hand, the gaseous pressure has decreased down to a level of 5 kg/cm$^2$ or less, the heat directing fan is automatically rotated to cause promotion of the vaporization of the liquefied gas in the gas tank. At the same time, the solenoid valve on the liquid line is opened to permit the vaporization of the liquefied gas in the vaporizers. Further, where in winter season, a plurality of vaporizers are in some cases all caused to make their operations, or in other cases only one of them is operated, whereby the vaporizing operation can automatically be controlled in accordance with the variations in the pressure of the gas so as to cause the gas of uniform pressure to be supplied to the heating panels. That is to say, even when the temperature of the open air varies during the heating operation to promote the vaporization in the gas tank to cause variation in the gaseous pressure, automatic control works to cause such gaseous pressure to be kept at a uniform level.

BRIEF DESCRIPTION OF THE DRAWINGS

An embodiment of the present invention is illustrated in the drawings in which.

DESCRIPTION OF THE PREFERRED EMBODIMENT

An embodiment of the present invention will now be described with reference to the drawings.

Figure 1:
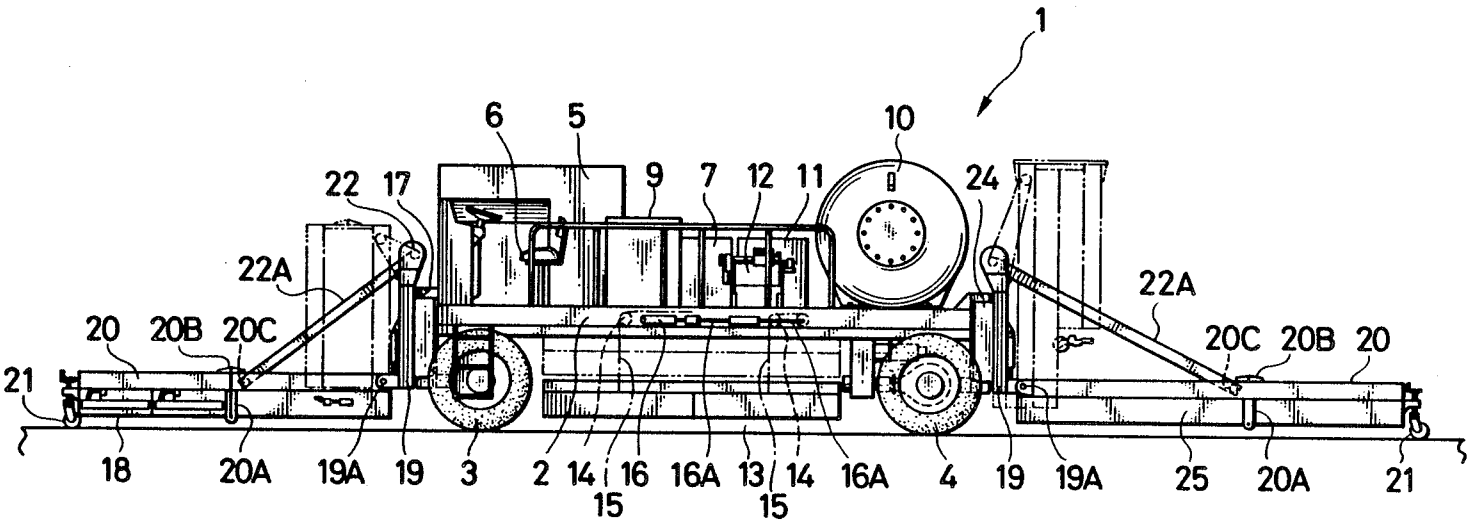
FIG. 1 is a side view of a road surface heating vehicle.
Figure 2:
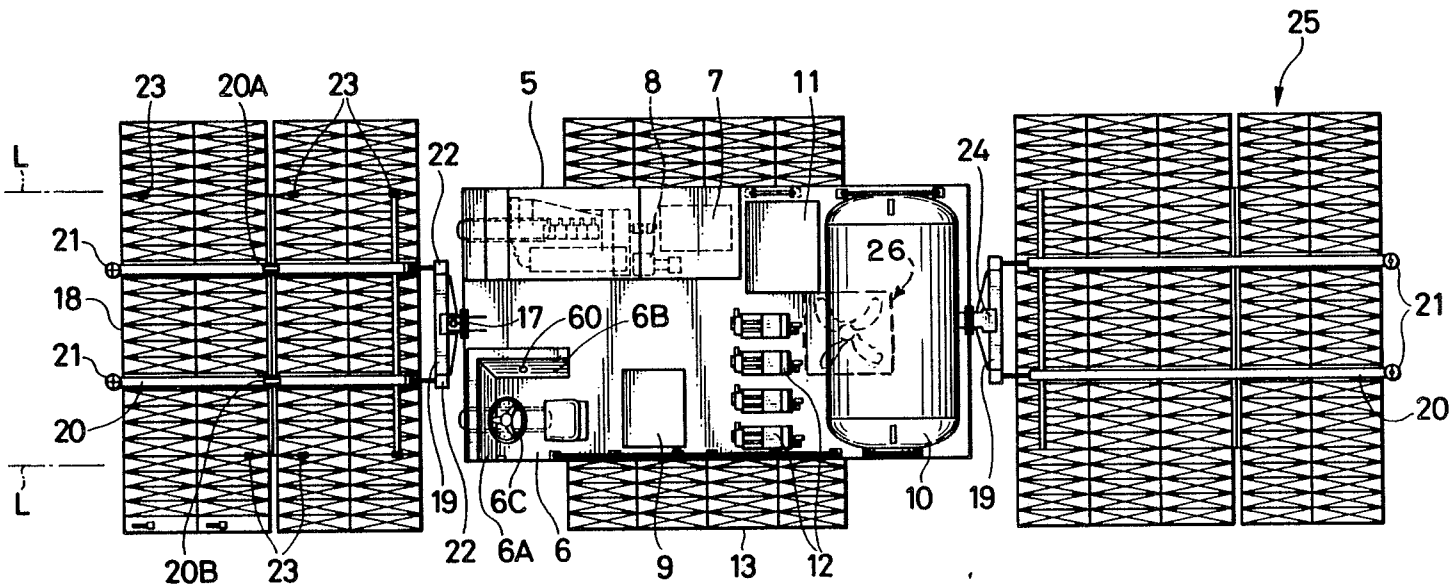
FIG. 2 is a plan view thereof.

Referring now to FIG. 1 which is a side view of a road surface heating vehicle and FIG. 2 which is a plan view thereof, the road surface heating vehicle 1 has a body 2 below which are disposed a pair of front wheels 3, 3 and a pair of rear wheels 4, 4 in the same manner as in the case of an ordinary automobile, the rear wheels 4 being constructed as drive wheels and the front wheels 3, 3 as steerable wheels. The upper surface of the body 2 is made flat and, on the front part thereof, an engine unit 5 and an operator's seat 6 are disposed at both sides of the front part respectively, the engine unit 5 being adapted to drive the rear wheels 4, 4 via a transmission mechanism not shown. At the back of the engine unit 5 there are disposed a generator 7 and a hydraulic pump 8 each of which is so constructed as to be supplied with power from the engine unit 5.

At the front side of the operator's seat 6 there are disposed various measuring devices 6A, an operating board 6B containing a microcomputer, and a steering wheel 6C which is constructed to steer the front wheels 3, 3. At the back of the operator's seat 6 there is disposed a tank 9 in which a fuel and oil are received.

Disposed on the rear part of the body 2 is a large-sized gas tank 10, at the front side of which are disposed a valve stand 11 and vaporizers 12,—, which are connected to the gas tank 10 by way of a gas line. Beneath the body 2 and between the front wheels 3 and the rear wheels 4 there is disposed a central heating panel 13 in such a manner that the same can be raised and lowered. More specifically, in FIG. 1 sheaves 14, 14 are disposed on the body 2 in such a manner that their axes are perpendicular to the longitudinal direction of the body 2. Suspending wires 15, 15 are applied over the sheaves 14, 14, respectively. Mounted horizontally on the body 2 is a cylinder 16 having a piston rod 16A which is connected, at its tip end, with respective upper ends of the suspending wires 15, 15. From respective lower ends of the suspending wires 15, 15 there is suspended the central heating panel 13 which thus is raised or lowered by operation of the cylinder 16 so that its positional level as measured from the road surface may be adjusted. The central heating panel 13 is connected with a gas passageway 44A which is led from the vaporizers 12,—. Further, the central heating panel 13 is allowed to widely spread outwardly from the side, or widthwise end, of the body 2. However, when the vehicle body 2 is travelled at a time other than a remedy construction involved, the central heating panel 13 can have its outwardly spread portions folded back at hinges, not shown, which are provided right beneath the widthwise end faces of the body 2, respectively.

Disposed at the front side of the body 2 is a front heating panel 18 via a supporting columnar member 17 vertically erected also at the front side of the body 2, the supporting columnar member 17 being mounted thereon with a main frame 19 assuming a square shape as viewed from the front side of the body 2, in such a manner that it is perpendicular to the longitudinal direction of the body 2. On a lower end portion of the main frame 19 there is mounted a lower frame member 20 via shafts 19A, such that the same 20 extends horizontally forwardly from the lower end of the main frame 19. At the central portion of the lower frame member 20 as viewed longitudinally thereof, there is provided a hinge 20A at which the lower frame member 20 can be two folded. The reference numeral 20B denotes a means of fixing the two-folded portions of the lower frame member 20 in a state wherein they are kept at their horizontally laid posture. At the forward end of the lower frame member 20 there are disposed a pair of supporting wheels 21, 21 which are intended to cause the forward end portion of the lower frame member 20 to be maintained horizontal.

A pair of winches 22, 22 are mounted, respectively, on both widthwise, upper, end portions of the main frame 19. From the winches 22, 22 there are extended a pair of hoisting wires 22A, respectively, which are wound around sheaves 20C attached onto the lower frame member 20, respectively. Thus, when the fixation made by the fixing means 20B is released and the winches 22, 22 are driven for hoisting operation, the lower frame member 20 is erected about the shafts 19A in a manner that its central part rises with its forward end portion being directed downwards. On the underside of the lower frame member 20 there is fixed the heating panel 18 which is allowed to spread more widely than the width of the body 2, the heating panel 18, however, being so constructed that its widthwise end portions can each be folded back downwards, at its corresponding hinges 23, from a position located slightly inwardly from a corresponding line L indicating the corresponding widthwise end of the vehicle body 2. The heating panel 18 is connected with a gas passageway 44A which is led from the vaporizers 12,—.

At the back of the body 2 there is disposed a rear heating panel 25 via a supporting columnar member 24. The main frame 19 and lower frame member 20 adapted to support the rear heating panel 25, as well as the other associated structures and members, are the same as in the case of the front heating panel 18. Therefore, the same portions and members are denoted by like reference numerals, respectively, and description thereof is omitted.

The foregoing is a general description of the road surface heating vehicle. A systematic construction and action thereof which extend from the gas tank 10 to the heating panels 13, 18 and 25 will hereinafter be described with reference to FIGS. 3, 4 and 5.

Figure 3:
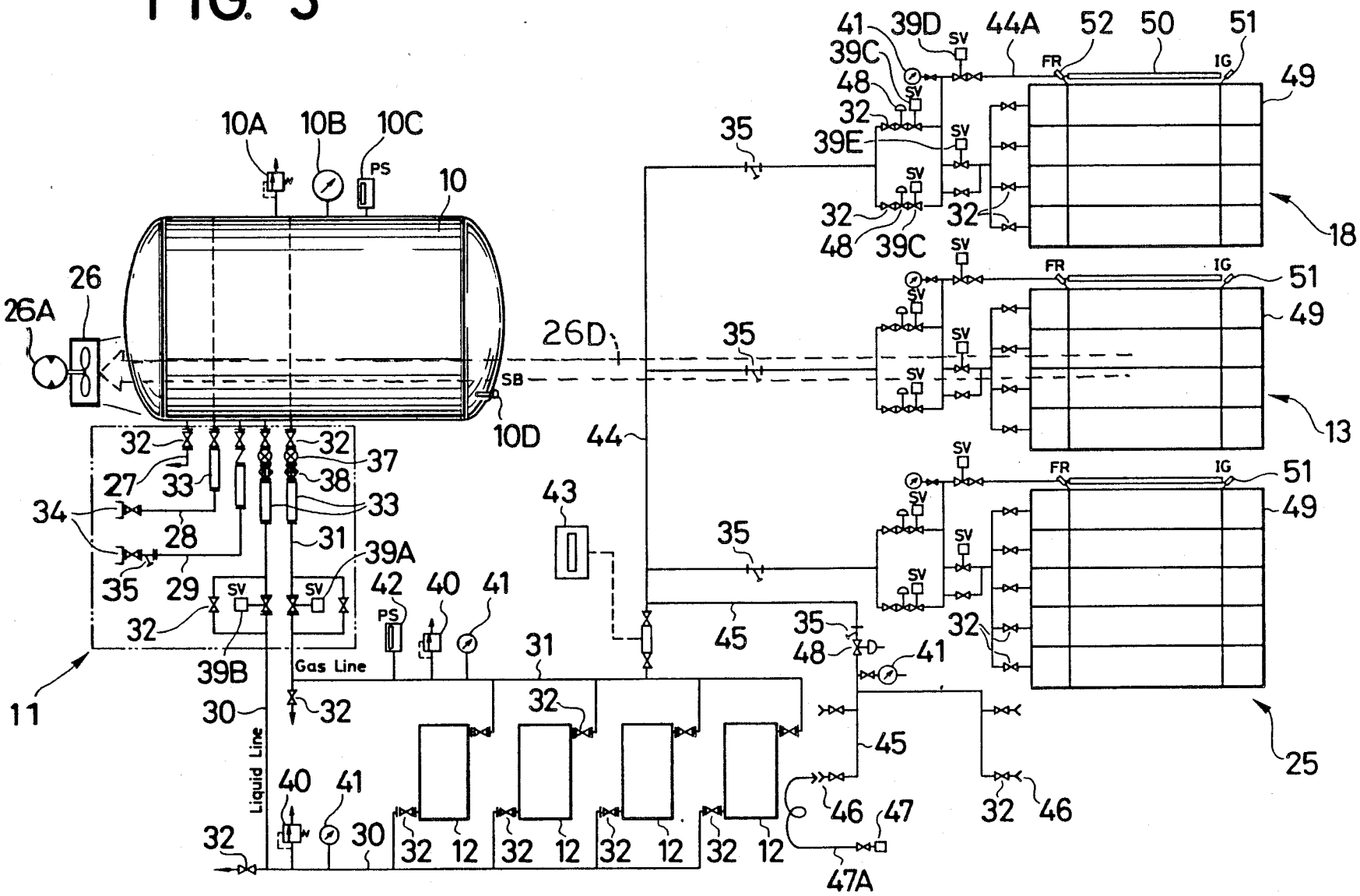
FIG. 3 is a systematic diagram showing the supply of gas effected by a gas supply system.

Referring to FIG. 3, the gas tank 10 is equipped with a safe+v valve 10A, a thermometer 10B, a pressure switch 10C and a temperature control valve 10D. At the side of the gas tank 10 there is disposed a heat directing fan 26. Fan 26 can be installed, for example, in the floor of the truck body as shown in phantom lines in FIG. 2 or vertically, beside the tank as shown in FIG. 3. In either case, a duct **26*d* (shown schematically in phantom lines in FIG. 3) is preferably provided under the floor of the truck body to convey hot exhaust gases from the heating panel(s) to fan 26. Thus, when required, the fan directs hot exhaust gases from the heating panels, via duct 26*d*, towards gas tank 10 to promote vaporization of the liquefied gas in the tank. Fan 26 is driven to rotate by operation of a liquid-pressure driven motor 26A. The heat directing fan 26 is intended to be used for promoting the vaporization of the liquefied gas in tank 10**.

In the section of the valve stand 11, the following are disposed. Extended from the gas tank 10 are two gas lines 28, and three liquid lines 27, 29 and 30 each of which is mounted with a manually operable valve 32. The liquid line 27 is intended to discharge the liquefied gas in the gas tank 10. The next gas line 28 is connected, at its starting end, with a flexible tube 33 and is provided, at its tip end, with a coupling 34 so as to make this line 28 serviceable for supplying the gas for other use purposes. The next liquid line 29 is intended to be used for injecting the liquefied gas into the gas tank 10, the line 29 being provided, at its tip end, with a coupling 34 and a strainer 35, and also provided with a flexible tube 33 and a non-return valve 36. The next two lines are a liquid line 30 for supplying the liquefied gas from the gas tank 10 into the vaporizers 12, and a gas line 31 which is a passageway for permitting the passage therethrough of the gas liquefied within the gas tank 10. The reference numerals 37, 38 and 39A and 39B denote an emergency valve closed in case of emergency, a check valve, and solenoid valves, respectively.

The liquid line 30 is connected to the four vaporizers 12,12 —, respectively, via manually operable valves 32, 32—and is provided, at its intermediate portion, with a safety valve 40 and a pressure gauge 41.

On the other hand, the gas line 31 is connected to the four vaporizers 12, 12,—, respectively, via manually operable valves 32, 32,—, and is provided, at its intermediate portion, with a pressure switch 42, a safety valve 40 and a pressure gauge 41.

From the gas line 31 there extends a first branch line 44 from which further extend second branch lines which are connected to the heating panels 13, 18 and 25 respectively, the first branch line 44 being provided, at its midway portion, with a flow meter 43, the second branch lines being provided, at their midway portions, with strainers 35, 35 and 35 respectively. From the first branch line 44 there extends a third branch line 45 which is provided, at its tip end, with a coupling 46. To this coupling 46 there can be connected a gas hose 47A of a hand burner 47. In the Figure, the reference numeral 48 denotes a pressure control valve.

Each heating panel 13, 18 or 25 is mounted with a burner 49 and a line burner 50. The heating panel is connected with the gas line 44A extending from the corresponding second branch line of the first branch line 44 so as to be supplied with the gas. An ignition 51 is provided at a position close to the corresponding line burner 50. The reference numeral 52 denotes a flame rod. The gas line 44A, as shown, is equipped with a manually operable valve 32, a pressure adjusting or control valve 48, solenoid valves 39C, 39D. 39E, and a pressure gauge 41. The line burner 50 is of automatically ignitable type. In immediate front of the respective burners 49,—of the heating panels 13, 18, 25 there are disposed three groups of manually operable valves 32, —, respectively, such that the manually operable valves 32,—of each group are provided in corresponding relationship to the burner units of the burner 49 involved. By individual operations of the manually operable valves 32,—of each group it is possible to limit the supply of the gas to the corresponding burner units of the burner 49 involved.

The gas tank 10 is 4.7 $m^3$ in volume and can receive therein two tons of liquefied propane gas.

The heating panel 13, 18 or 25 is of an infrared radiation system which uses propane gas as the fuel. The total amount of heat generated from one heating panel is 3, 718, 000 Kcal/H at maximum. The amount of heat being generated from each heating panel can be controlled by operations of its corresponding pressure control valve 48 and manual valves 32. Besides, the height of each heating panel 13, 18 or 25 as measured from the surface of a road involved can also be adjusted.

The overall widthwise dimension of a zone heatable by the heating panels 13, 18 and 25 is in the range of 3.0 to 4.5 m, the heating operation thereof being able to be controlled at breadthwise space intervals of 15 cm. The heating panel 13, 18 or 25 is adapted to have its heating operation so controlled that the maximum heating temperature for a road surface may be 260° C. or less, that the bottom temperature of a road surface layer as scarified may be 60° C. or more, and that the mean temperature of a mixture as scarified may be in the range of 100° C. to 130° C.

Of the above-mentioned equipments, the thermometer 10B, pressure switch 10C, pressure gauge 41, fan motor 26A, solenoid valves 39A, 39B, 39C, 39D and 9E, control devices for the vaporizers 12, etc. are electrically connected to the microcomputer housed within the operating board 6B so as to be controlled in accordance with specified programs.

Figure 4:
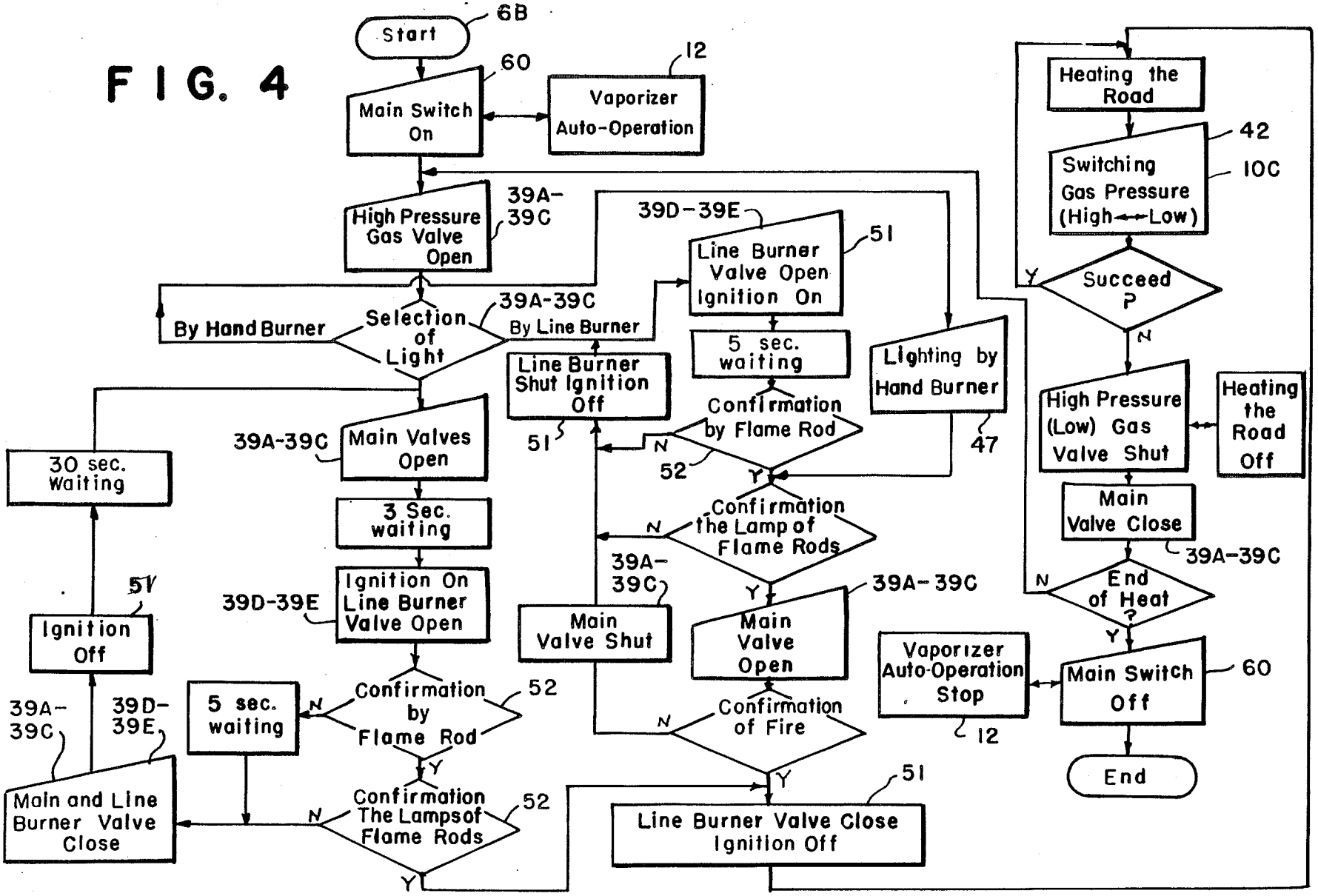
FIG. 4 is a flow chart showing the operation carried out by the gas supply system.

The sequence of operations for causing the gas to be supplied from the gas tank 10 to the heating panels 13, 18 and 25 will now be described. FIG. 4 is a systematic view illustrating the sequence of operations for the gas burner 49. A main switch 60 is turned on to cause the performance of the operation of opening the solenoid valves 39A and 39B as well as the automatic control operation for the vaporizers 12.

Next, selection is made, in the operating board 6B, of the heating panel 13, 18 or 25. Then, the solenoid valve 39D of the line burner 50 corresponding to the selected heating panel is opened and then the ignition 51 is made on. The flame rod 52 is checked after the lapse of five waiting seconds. If the flame rod 52 is turned red, a confirmation lamp not shown will be lit. If the flame rod 52 is confirmed to have not been turned red, the solenoid valve 39D of the line burner 50 is closed while, on the other hand, the ignition 51 is made off. When the flame rod 52 has been turned red, the solenoid valve 39E of the heating panel 13, 18 or 25 is opened. Thereafter, the heating panel is checked for confirmation of fire. If the heating panel is not set on fire, the solenoid valve 39E is closed. Conversely, if the heating panel involved is set on fire, the solenoid valve 39D of the line burner 50 is closed and, at the same time, the ignition 51 is made off. Whereby, the road surface layer can be heated.

Next, the gas pressure switch 42 which has been made on is changed over to either a "high level" or a "low level". When this changing-over operation has successfully been accomplished, the corresponding gas feeding operation is continued accordingly. When the changing-over operation has failed in causing the desired gas feeding operation to be carried out, the gas pressure switch is made off and the solenoid valve 39E is shut. Then, the operation is restarted from the outset. When the heating work has been finished, the road-surface heating is rendered ineffective, followed by the turning off of the main switch 60.

Figure 5:
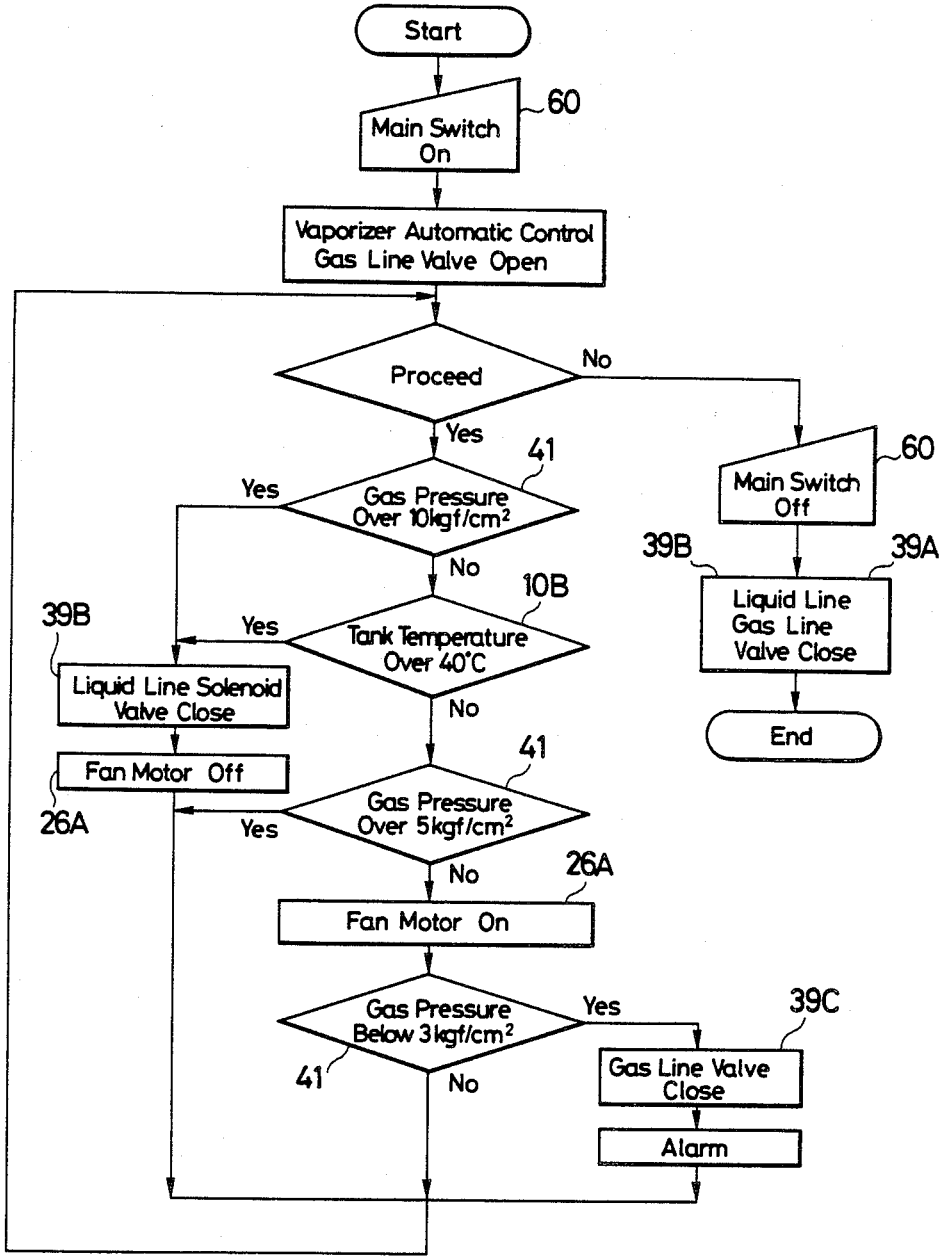
FIG. 5 is a flow chart showing the sequence of the control operation performed by the gas supply system.

FIG. 5 is a flow chart illustrating the automatic control system for the gas supplying operation. The vaporizer 12 is of a type wherein a heating pipe line not shown is received within a case body, the heating pipe line being heated by an electric heater, and the liquefied gas being circulated through the heating pipe line for vaporization. The flowrate of the gas is automatically controlled through controlling the calorie of the electric heater as well as the flow of the liquefied gas allowed to pass through the heating pipe line.

First of all, in the operator's seat 6, an operator turns on the main switch 60 of the operating board 6B. Thus, the automatic control system for the vaporizers 12,—starts to operate while, on the other hand, the solenoid valves 39B and 39A mounted respectively on the liquid line 30 and gas line 31 are opened. Thus, the supplying of the gas starts to be effected. When the gaseous pressure gauge 41 indicates that the pressure of the gas exceeds a level of 10 kg/cm$^2$, the solenoid valve 39B of the liquid line 30 is shut. Even when the pressure of the gas is below a level of 10 kg/cm$^2$, the solenoid valve 39B of the liquid line 30 is shut to render the supply of the liquefied gas to the vaporizers 12,—ineffective if the thermometer 10B equipped on the gas tank 10 indicates that the temperature of the gas tank 10 is over 40° C. And the fan motor 26A is stopped from rotating. Whereby, only the gas which has been vaporized in the gas tank 10 is supplied to the heating panels 13, 18 and 25. When the pressure of the gas thus supplied is kept at a level of 5 kg/cm$^2$ or more, supplying of the gas is smoothly effected as it stands. However, when the pressure of the gas decreases down to a level of 5 kg/cm$^2$ or less, an input is automatically supplied into the fan motor 26A, so that the heat directing fan 26 is caused to rotate, thereby promoting the vaporization of the liquefied gas in the tank 10. Insofar as the pressure of the gas being supplied does not become lower than 3 kg/cm$^2$, the gas continues to be supplied as it is. However, when the pressure of the gas decreases to a level lower than 3 kg/cm$^2$, the solenoid valve 39A of the gas line 31 is closed to cause the generation of an alarm (lamp, sound). At this time, the solenoid valve 39B of the liquid line 30 is opened with a simultaneous starting of the vaporization operation of the vaporizers 12,—. Thereafter, the same control operation as mentioned before is carried out. At the time of stopping the heating work, the main switch 60 is turned off to cause a closing of the solenoid valves 39A, 39B, 39C, 39D and 39E.

As has been described above, in the present gas supply system, the pressure of the gas being supplied to the heating panels is checked so as to control the vaporization operation of the vaporizers, thereby maintaining the degree of heating to be uniform. On the other hand, the temperature as well as the pressure of the gas in the tank is also checked so as not only to control the operation of the fan but also to secure making the operation safe. Thus, there is no risk that the gaseous pressure excessively increases in level, to make it possible to execute the remedying or heating work safely. Further, the control of the gaseous pressure can be effected regardless of the particularity of the seasons, or regardless of the morning, afternoon or evening in the same day as well as of the distance as measured from the sea level, the temperature of the atmosphere, etc. This makes it possible uniformly to heat the surface of a road involved, thus enhancing the working efficiency.

The present invention has the following advantages.

(1) The invention employs not gas cylinders of small size but a gas tank of great dimension. Therefore, once the liquefied gas has been charged into the gas tank, the heating operation can be performed during a considerably long period of time. This eliminates the necessity of, for example, frequently loading and unloading the gas cylinders, so that the working efficiency is enhanced.

(2) A plurality of vaporizers are disposed in parallel with respect to the portion of the gas line between the gas tank and the heating panels. Therefore, if the spontaneous vaporization alone of the liquefied gas in the gas tank is insufficient for achieving the intended gas-supplying purpose, the liquefied gas can be supplied from the gas tank to the vaporizers so as to positively vaporize the liquefied gas. In addition, the operation of the vaporizers can be controlled such that all in some cases, or one in other, of such vaporizers is operated in accordance with the temperature of the open air and the amount of the gas used. This makes the heating operation possible with no deficiency in the gaseous pressure even in cold or mountainous districts.

(3) The invention is constructed such that the temperature of the gas tank and the gaseous pressure of the gas line are checked with subsequent operations of, when the temperature and gaseous pressure are higher than specified, stopping the fan operation, closing the solenoid valve of the liquid line, and rendering the vaporization operation of the vaporizers ineffective, the subsequent operations further including those of, when said gaseous pressure decreases below a specified level, operating the fan and at the same time rendering the vaporization operation effective. This prevents the gaseous pressure from excessively rising above a specified level, to provide a safe heating operation. Further, since the invention enables the gaseous pressure to be kept, in any place under any conditions, to fall within a specified range of levels, it is possible to effect a uniform heating of a road surface involved.

What is claimed is:

1. A road surface heating vehicle having an automotive body and equipped, on the underside of that automotive body, with heating panels and, on said automotive body, with a gas tank, the vehicle comprising a plurality of vaporizers disposed on said automotive body, said plurality of vaporizers being connected in parallel to each other by means of a gas line and a liquid line both of which extend from said gas tank, said gas line branching into branch lines, said branch lines being connected to respective burners of said heating panels, a solenoid valve and a pressure adjusting valve mounted in line with each of said liquid and said gas line, a thermometer and a pressure adjusting valve operatively coupled to said gas tank, a heat directing fan mounted to said automotive body at one side of said tank and in facing relation thereto for selectively directing hot exhaust gases conveyed thereto from at least one of said heating panels toward said tank so as to promote vaporization of liquefied gas disposed in said tank, said automotive body having disposed thereon an operating board containing therein a microcomputer to which there are connected electric circuits for a control system for said vaporizers, said solenoid valves, said pressure adjusting valves, said thermometer, and a fan motor used to drive said fan, whereby, when the gaseous pressure in said gas tank has exceeded a specified level, said microcomputer automatically causes a closing of said solenoid valve in said liquid line and at the same time causes a stopping of the fan operation, whereas, when the gaseous pressure has decreased down to a specific level, said microcomputer automatically causes a starting of the fan operation and at the same time causes opening of said solenoid valve in said liquid line so as to cause operation of said vaporizers.

2. A gas supply system for a road surface heating vehicle, comprising a gas tank loaded on said vehicle, a heater provided on a body of said vehicle, a gas line provided between said gas tank and said heater, a plurality of vaporizers connected in parallel to said gas line, a liquid line connected to said plurality of vaporizers, and a microcomputer provided within an operating board provided on said body of said vehicle, said gas line and said liquid being each mounted with a solenoid valve, said gas tank being provided with a solenoid valve, said gas tank being provided with a thermometer and a gaseous pressure gauge and also provided, at the outside thereof, with a heat directing fan for selectively directing hot exhaust gases conveyed thereto from said heater toward said tank so as to promote vaporization of liquefied gas disposed in said tank, said microcomputer being connected thereto with electric circuits for said vaporizers, said solenoid valves, said thermometer, said gaseous pressure gauge, and a fan motor, whereby said microcomputer performs its control operation in such a way that when, in operation, the pressure of gas contained in the tank being kept at a level of 10 $kg/cm^2$ or more, or alternatively when the temperature of said gas tank has exceeded a level of 40° C., it automatically causes a closing of said solenoid valve on said liquid line and at the same time a stopping of said fan motor, whereas, when, in operation, said pressure of the gas being supplied has decreased down to a level of 5 $kg/cm^2$ or less, said microcomputer automatically causes a rotation of said fan motor and at the same time causes opening of said solenoid valve on said liquid line so as to cause operation of said vaporizers.

* * * * *